US007983579B2

(12) United States Patent
Swift et al.

(10) Patent No.: US 7,983,579 B2
(45) Date of Patent: Jul. 19, 2011

(54) SYSTEM AND METHOD FOR DETERMINING AN AMOUNT OF TONER MASS ON A PHOTORECEPTOR

(75) Inventors: Joseph Swift, Ontario, NY (US); Eric Gross, Rochester, NY (US); Charles Radulski, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 330 days.

(21) Appl. No.: 12/399,878

(22) Filed: Mar. 6, 2009

(65) Prior Publication Data

US 2010/0226668 A1 Sep. 9, 2010

(51) Int. Cl.
*G03G 15/00* (2006.01)

(52) U.S. Cl. ..... 399/49; 399/72

(58) Field of Classification Search ..... 399/38, 399/46, 49, 58, 60, 72; 250/208.1, 226
See application file for complete search history.

(56) References Cited

U.S. PATENT DOCUMENTS

| | | | | |
|---|---|---|---|---|
| 6,218,660 | B1 * | 4/2001 | Hada | 250/226 |
| 6,452,147 | B1 * | 9/2002 | Inada | 250/208.1 |
| 7,639,957 | B2 * | 12/2009 | Kato et al. | 399/30 |
| 2008/0089708 | A1 | 4/2008 | Gross et al. | |

FOREIGN PATENT DOCUMENTS

| | | |
|---|---|---|
| JP | 06337597 | 12/1994 |
| JP | 09297466 | 11/1997 |
| JP | 11084765 | 3/1999 |

OTHER PUBLICATIONS

European Search Report dated Jun. 1, 2010, Application No. 10154512.7-2209, 6 pages.

* cited by examiner

*Primary Examiner* — Hoan Tran
(74) *Attorney, Agent, or Firm* — Pillsbury Winthrop Shaw Pittman LLP

(57) ABSTRACT

A light-transmissive transfer belt used in the system for determining toner mass amount and methods for making the belt. A system and method, using the transparent transfer belt, is capable of determining an amount of toner mass present on a toner application surface, and the real-time adjustment of parameters controlling xerographic transfer performance in the system. The system includes transmission-based sensors alone and in combination with reflective-based sensors.

23 Claims, 4 Drawing Sheets

SYSTEM AND METHOD FOR DETERMINING AN AMOUNT OF TONER MASS ON A PHOTORECEPTOR

CROSS REFERENCE TO RELATED APPLICATIONS

Reference is made to co-pending, commonly assigned U.S. patent application to Gross et al., filed Mar. 6, 2009, entitled, "Photoreceptor Transfer Belt and Method for Making Same" Ser. No. 12/399,873.

BACKGROUND

The present invention relates generally to a system and method for determining an amount of toner mass present on a toner application surface, and the real-time adjustment of parameters controlling xerographic transfer performance in the system. The present embodiments are also directed to a light-transmissive transfer belt used in the system for determining toner mass amount and methods for making the belt. It is to be appreciated that the following embodiments may be used with both drum or belt photoreceptors and in intermediate transfer belt (ITB) and biased transfer belt (BTB) and biased transfer roll (BTR) systems.

Conventional printing devices exist in which a photoreceptor belt is used to provide toner mass to a base medium (e.g., paper). In order to accurately control the amount of toner mass being delivered to the base medium, these devices may include transfer systems that determine the amount of toner mass being transferred to and carried by the photoreceptor belt. With each generation of printing devices, it is desirable to enhance xerographic performance through use and control of the transfer systems.

Optical sensors are known and used in printing systems to detect transferred toner mass amounts through reflectance measurements. For example, U.S. Publication No. 2008/0089708, discloses use of optical reflective-based sensors to generate and compute reflection outputs to determine an amount of toner mass present on the toner application surface. However, these sensors have significant limitations. In particular, current optical reflective based sensors are unable to measure masses beyond a certain amount and are not capable of providing fine or ultra fine details about pre- or post-transferred images. Moreover, the systems using such sensors tend to be temperamental and sensitive to changes to the photoreceptor belt, and/or other components of the printing device, that occur due to wear. For example, the surface of the photoreceptor belt may degrade over time such that surfaces on the belt become less reflective, less uniform, etc. This may cause light that is directed to the belt (e.g., for the purpose of measuring the amount of toner mass present, etc.) to be "lost" in the system through absorption, scattering, and/or transmission. The loss of light caused by imperfections in the belt, and/or other components of the printing device may require relatively frequent calibration of the device using a relatively intricate and time consuming process. It is well known that transfer set points are a strong function of such key time varying "noise" factors such as belt material properties, paper states, and environmental variation. Unfortunately, each of these can interact in a complex and difficult to control manner.

Thus, new and effective means to provide accurate sensing of toner mass on transfer belts is important to future enhancement of toner transfer and overall xerographic performance. In this regard, a transfer system that can provide real-time measurement and feedback of critical xerographic control parameters or variables will be highly desirable. There are currently no transfer systems that can provide precise transfer control and real-time feedback for optimization of the xerographic transfer process.

SUMMARY

According to aspects illustrated herein, there is provided a system for providing detection and adjustment of toner transfer performance, comprising a light-transmissive transfer belt for receiving an amount of toner mass, a transmission sensor for sensing light transmission through the light-transmissive transfer belt, the sensor comprising a light source positioned over the light-transmissive transfer belt for applying light to a position on a surface of the light-transmissive transfer belt where the amount of toner mass is to be transferred, and a receiver positioned on a side of the light-transmissive transfer belt opposite from the light source for receiving and measuring an amount of light that passes through the light-transmissive transfer belt, and a measurement and control circuit connected to the transmission sensor for computing a difference in light transmission with and without an amount of toner mass on the surface of the light-transmissive transfer belt, wherein the difference in light transmission is used to calculate a transfer parameter that can be used to adjust toner transfer performance.

Another embodiment provides a system for providing detection and adjustment of toner transfer performance, comprising a light-transmissive transfer belt for receiving an amount of toner mass, a transmission sensor for sensing light transmission through the light-transmissive transfer belt, the sensor comprising a transmission light source positioned over the light-transmissive transfer belt for applying light to a position on a surface of the light-transmissive transfer belt where an amount of toner mass is to be transferred, and a first receiver positioned on a side of the light-transmissive transfer belt opposite from the transmission light source to receive and measure an amount of transmitted light that passes through the light-transmissive transfer belt, a reflective sensor coupled to the transmission sensor for sensing light reflected from the light-transmissive transfer belt, the reflective sensor comprising a reflective light source positioned over the light-transmissive transfer belt for applying reflective light to the position on a surface of the light-transmissive transfer belt where an amount of toner mass is to be transferred, and a second receiver positioned on a same side of the light-transmissive transfer belt as the reflective light source for receiving and measuring an amount of reflective light from the light-transmissive transfer belt, and one or more measurement and control circuits connected to the transmission sensor and the reflective sensor for computing a difference in at least one of intensity and frequency of transmitted light with and without an amount of toner mass on the surface of the light-transmissive transfer belt and a difference in at least one of intensity and frequency of reflective light with and without an amount of toner mass on the surface of the light-transmissive transfer belt, wherein the difference in the intensity or frequency of the transmitted light and reflective light is used to calculate a transfer parameter that can be used to adjust toner transfer performance.

Yet another embodiment, there is provided a method for detecting and adjusting toner transfer performance, comprising delivering a stream of transmission light to a position on a light-transmissive transfer belt where an amount of toner mass is to be transferred, receiving the light transmitted through the light-transmissive transfer belt with and without the amount of toner mass, measuring at least one of an intensity and frequency of the transmission light received through the light-transmissive transfer belt and determining a difference of at least one of the intensity and frequency of the transmission light received through the light-transmissive transfer belt with and without the amount of toner mass, calculating a transfer parameter that can be used to adjust toner transfer performance, and adjusting toner transfer performance responsively to the calculated transfer parameter, thereby optimizing such toner transfer performance. In a further embodiment, the method further includes delivering a stream of reflective light to the position on a light-transmissive transfer belt where the toner mass is to be transferred, receiving the light reflected from the light-transmissive transfer belt with and without the amount of toner mass, and measuring at least one of an intensity and frequency of the reflective light received from the light-transmissive transfer belt and determining a difference of at least one of the intensity and frequency of the reflective light received from the light-transmissive transfer belt with and without a toner mass.

BRIEF DESCRIPTION OF THE DRAWINGS

For a better understanding, reference may be made to the accompanying figures.

DETAILED DESCRIPTION

Figure 1:
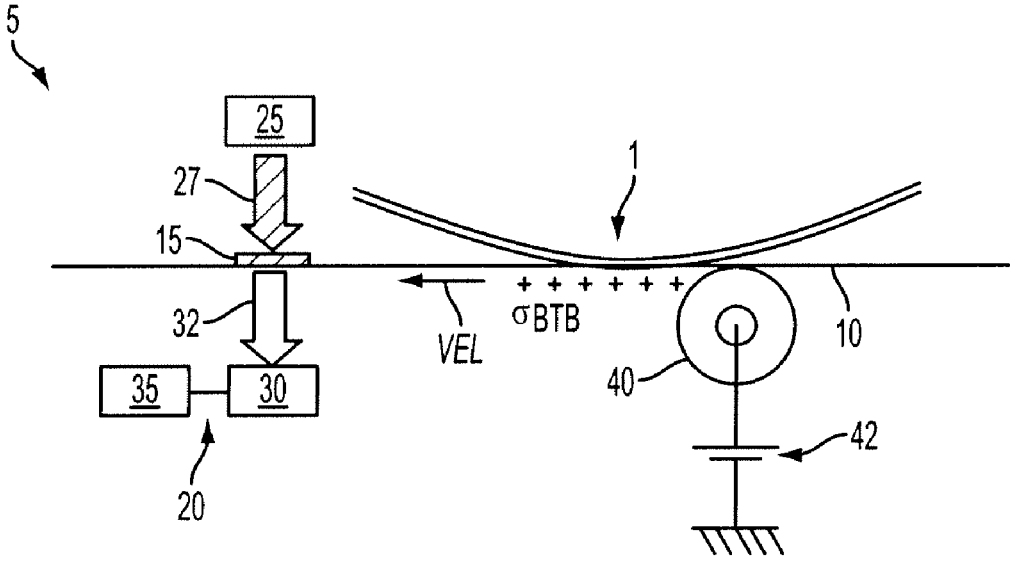
FIG. 1 is a schematic side view of a transfer belt system according to the present embodiments.

In the following description, reference is made to the accompanying drawings, which form a part hereof and which illustrate several embodiments. It is understood that other embodiments may be used and structural and operational changes may be made without departure from the scope of the present disclosure.

The performance of transmission-based sensors is generally superior to reflective-based sensors and provides more accurate measurements. For example, transmission-based sensors perform with a better signal to noise ratio which can provide meaningful sensing of local toner mass variations. However, in order to employ transmission-based methodologies, a light-transmissive belt is needed. Thus, the present embodiments also provide a clear or transparent or at least semi-transparent transfer belt having a specific composition suitable for use in a transfer system that determines toner mass amount with transmission-based sensors. The transfer belt can be used in both intermediate transfer belt (ITB) and biased transfer belt (BTB) and biased transfer roll (BTR) systems.

In further embodiments, a light-transmissive transfer belt suitable for use in the inventive transfer systems is provided. The transfer belt comprises an optically transparent polyvinylidene fluoride (PVDF), commercially available from Dynaox Inc. (Hyogo, Japan), with conductivity tuned using an ionically conductive filler into a suitable range. For example, the intermediate transfer belt may have a bulk resistivity defined herein as the arithmetic inverse of electrical conductivity of from about $1\times10^{2}$ Ωcm to about $10\times10^{12}$ Ωcm, or from about $1\times10^{9}$ Ωcm to about $10\times10^{12}$ Ωcm, such that charge employed for transfer, cleaning, and/or any other field-driven function can be sufficiently conducted through the belt and/or dispersed or dispelled across its surfaces. Owing to the fact that there exists a functional interdependence amongst the print quality and process speed of a printing system employing a bias transfer or intermediate transfer belt and the surface and volume resistivities of said belt, a particularly useful range of bulk resistivity for contemporary printing systems falls in the range of about $1\times10^{7}$ Ωcm to about $10\times10^{11}$ Ωcm. Contemporary high speed reprographic print engines producing from about 50 to 300 prints per minute would employ a transfer belt whose bulk resistivity would fall in a range of about $1\times10^{10}$ to $10\times10^{12}$ Ωcm.

In order to obtain the stated bulk resistivity values, suitable ionic and/or electronic conductive fillers are added to and blended with a polymer that is selected for the belt component. The addition of the ionic or other filler to the host polymer forms a composite wherein the bulk or volume resistivity is altered depending upon the type and amount of filler that is used and the processes that are employed to mix and disperse the filler into the host polymer and to form the transfer belt component. The selection and processing of such fillers into the host polymers resulting in formation of filled polymer composites having the desired properties are known to those skilled in the art. However, in embodiments the use of small loadings of electrically conductive or conductivity enhancing fillers are used in order to preserve the light-transmissive properties of the host polymer. These fillers may comprise one, or mixtures of two or more, selected from the group consisting of electrically conductive fillers such as single-walled carbon nanotubes, multi-walled carbon nanotubes, nano-sized metal or metal oxide particles such as nanoparticulate silver, gold, platinum, palladium, copper, tin, zinc, and mixtures thereof, and the like, and/or may include ionically conductive fillers such as ionic inorganic or organic salts, such as tetrahexylammonium halide salts such as tetrahexylammonium bromide and tetrahexylammonium chloride, tetraheptylammonium halides such as tetraheptylammonium chloride and bromide and the like as well as inorganic metal halides such as potassium chloride, potassium bromide, and mixtures thereof, and the like. In addition, hybrids such as metal interpenetrated organic salts may also be used which exhibit both electronic and ionic conduction mechanisms. In embodiments, the conductive filler or fillers may be present in an amount suitable to adjust the resistivity of the composite form from that of the unfilled polymer to the desired value and may fall into a range of from about 0.01 to about 20 weight percent. Typically, transparent or functionally transparent host polymers such as those cited herein are intrinsically electrically insulating. Other unfilled host polymers may exhibit a level of resistivity under certain conditions such as at elevated humidity or temperature, but in general do not possess a sufficiently low level of resistivity, or a level that is not sufficiently stable under the conditions required by the application to be fully utile. Since most host polymers have bulk resistivities that are unstable or are in the order equal to or greater than about $1\times10^{14}$ Ωcm, as noted earlier, the conductivity modifying fillers that reduce the bulk resistivity of the host polymer at the lowest filler levels while maintaining sufficient electrical stability, functional transparency, and mechanical strength of the resultant composite are those that are used for this application.

The term functional transparency is defined and used herein to mean that electromagnetic energy from any selected wavelength across the electromagnetic spectrum such as visible light, UV light, infrared light, x-ray and/or alpha radiation and/or acoustic energy for example can pass from one surface of the transfer belt member through to at least one other surface and emerge with sufficient energy intensity to be detected on the surface from which it emerged. Energy from any portion of the electromagnetic spectrum can be used for the sensing function(s) with the inventive transfer member. The frequencies or wavelength of energy can be wide or narrow spectrum or even mixed-frequency. The energy can be continuous or pulsed depending upon the specific requirements of the sensing application. In general, an energy type, intensity, and frequency is chosen to be compatible with the transmission characteristics of the light-transmissive belt member. In other words to assure that a large amount of the incident energy is not lost, for example by absorption by the belt member and/or converted to heat, and is transmitted effectively through the belt and available for the sensing function(s). Likewise, in general, the energy characteristics are chosen to enhance or maximize the detection properties of the toner layer and/or contamination that are carried upon the belt's surfaces. A balance is often sought when selecting the energy characteristics between the transmissive behavior of that energy by the belt and by the toner and/or contaminants.

Host polymers such as polyvinylidene fluoride (PVDF), polyimide (PI), polyethylene (PE), polyurethane (PU), silicones such as polydimethylsiloxanes (PDMS), polyetheretherketone (PEEK), polyethersulphone (PES), fluorinated ethylenepropylene (FEP), ethylenetetrafluorethylene copolymer (ETFE), chlorotrifluoroethylene (CTFE) polyvinlidene fluoride (PVF2), polyvinylfluoride (PVF), tetrafluoroethylene (TFE), mixtures and copolymers thereof, and the like are highly stable, strong, and optionally flexible when formed into thin layer films. In general any functionally transparent, film forming polymer can be used in the subject application including thermoplastic polymers and thermosetting polymers. The selected polymer will be light-transmissive, for example, be optically or otherwise functionally transparent in embodiments, to permit passage of the selected wavelength of energy through the thickness of the resultant transfer belt element. In general, conductivity modifying fillers are selected and employed that are compatible with the host polymer and its processing into a composite and that will adjust the bulk and surface resistivity of the belt member to a specified value while having little or no adverse effect upon the transparency or other, for example mechanical or thermal, properties.

Suitable fillers are added to the host polymer while the polymer is in either the molten (i.e. liquid) state or dissolved in a suitable solvent to form a solution. Examples of such solvents are aliphatic solvents, such as an aliphatic ketone, for example, acetone, methylethylketone (MEK) methylisobutylketone (MIBK) and the like, or aromatic solvents, such as toluene, cyclohexane and the like, or, mixtures thereof, and the like. A casting or sheeting process (via solution casting, spin coating, rotary casting, and/or film casting) is then employed and optionally followed by mechanical stretching and/or thermal annealing to produce a functionally transparent, composite film from the polymer/filler composite whereby the cast film has a significant increase in electrical conductivity when compared to the unfilled polymer. The conductivity can be tailored such that it falls into a region where it is useful as a xerographic intermediate transfer belt (ITB) and/or a biased transfer belt (BTB) and/or a biased transfer roll (BTR). Additional fillers may be used that modify and/or stabilize secondary, but functionally important properties of the belt member such as its chemical resistance to acids or bases or any reactive gaseous, solid, or liquid species such as for example oxidation resistance to ozone attack, its thermal and/or dimensional stability, its flammability, porosity, tensile and flexural modulus, friction, dirt or contamination resistance, and the like. Fillers to modify or enhance the optical properties of the composite such as gloss enhancing fillers may also be used. While the use of such fillers for these purposes is known, in general, their specific use to modify the belt element of the present invention is being disclosed herein.

As noted, the electric or electrostatic field dependence as well as the temperature and room humidity (RH) dependence of the belt element's surface or bulk resistance can be tailored by the addition of a suitable electrically conductive filler. In practice, those fillers that modify or control more than one property in addition to bulk resistivity are used. In embodiments, an electronic filler such as single or multiple walled, carbon nanotubes may be present in an amount of from about 0.1 to about 5.0 weight percent. Electronic conductors such as small particle carbon fillers, carbon nanotubes, nano particle metals, mixtures thereof, and the like, can be used. For example, one or more fillers may be at least one of carbon nanotubes in the range of from about 1.0 to about 3.0 weight percent or polymer soluble ionic salts, such as a quartinaryammonium halide salt, for example, tetraheptylammoniumbromide (THAB), tetraheptylammoniumchloride (THAC), and the like.

The polymer composite material is formed into a continuous thin film which is manufactured into appropriate thickness ranges and can be formed into belts through ultrasonic seaming, thermal welding, chemical bonding, mechanical interlocking, or other suitable seaming methods. Alternately, continuous belt members having the desired circumference, width, and thickness may be cast, for example by rotary casting, from a polymer composite that begins in a liquid phase such as in a solution, melt or molten phase, or in a pre-polymerized state using a suitable mold or other vessel that establishes the desired dimensions of the resultant belt element. Film casting methods such as spin casting, rotary casting, and the like are suitable methods to manufacture belt elements of the present invention. While any thickness of composite can be fabricated, typically transfer belt members are characteristically thin and flexible having thicknesses that range from about 10 microns to about 1000 microns. Since thinner belts generally require less material and less energy, thicknesses in the range of about 20 to 100 microns may be used.

Reflective-based sensors measure electromagnetic intensity from the incident energy that is reflected from the surface of the transfer belt. Without any toner mass on the transfer belt, the reflected energy, for example visible light energy, will be generally all specular. However, as there is more toner mass on the transfer belt, the reflected light will tend to become more diffuse. Once the entire transfer belt layer is covered with a monolayer or more of toner mass, the intensity of the reflected or refracted energy can drop significantly and can drop to a very low level, for example to 0 or to a level that may be difficult to detect. In contrast, the transmission-based sensor measures energy that passes through the transfer belt as well as any toner or other mass, for example contamination in the form of fine particles that reside on the transfer belt. In present embodiments employing a light-transmissive transfer belt in the printing system, makes the use of a transmission-based sensor in this manner possible. Transmission-based sensors are typically very sensitive to the energy being detected and often have a much higher saturation point than reflective-based sensors, and thus, can continue to detect energy intensity through more than one toner monolayer before saturation is reached. The energy being absorbed before being transmitted to the sensor member will vary not only with toner layer thickness and uniformity, but also with the toner formulation (for example "darkness"), including specific color, being transported on the transfer belt. Thus, the transmission-based sensors, unlike reflective-based sensors, allow precise sensing of the toner mass amounts even when the amounts comprise multiple layers of toner and or other mass, for example contaminants which may be in particulate or liquid form. Often, the very fine particle sized additives that are used in toners such as processing aides, lubricants, charge control agents and the like, or debris from paper or other sources, can be transferred onto the surface of the transfer member and reside thereon thereby contaminating the surface. In embodiments, the sensors can be used to measure contaminants while suitable control methodologies for example to the transfer fields and/or cleaning fields can be employed to minimize or eliminate any unwanted effects from such contamination. The transmission-based sensors are also capable of providing fine image detail sensing used in the transfer system to determine real-time transfer optimization.

In FIG. 1, there is provided a present embodiment of a transfer system 5 used with a suitable photoreceptor 1. The photoreceptor 1 may be in the form of either a drum or belt. The transfer system 5 comprises a light-transmissive transfer belt 10 upon which a toner mass 15 is transferred. The transfer system 5 further comprises a light transmission sensor 20 having a light source 25 to deliver a stream of light 27, which may be a wide area or narrow-area type device and employing a wide spectrum or narrow spectrum, such as a monochromatic energy profile, located on one side of the light-transmissive transfer belt 10, and a receiver 30 located on the other side of the belt and light source 25. The sensor light source 25 and receiver 30 are positioned at counter-facing locations. The sensor 20 is connected to a measurement and control circuit 35 that computes a difference in light transmission 32 with and without a toner mass on the surface of the transfer belt 10. The sensor 20 thus serves to receive, process, display and/or transmit a suitable output signal such as a digital or analog signal to the measurement and control circuit 35. The transfer system 5 also includes a biased transfer back up roller 40 coupled to a suitable voltage or current source 42 to deliver charge to the backside of the transfer belt 10.

FIG. 1 represents one embodiment that is capable of sensing various colored toner masses and multiple layers thereof, which may reside on the belt's surface either before and/or after transfer of the primary image to media. As noted earlier, if the frequency of light energy or of the beam of light in this case is selected such that it passes nearly uninterrupted through the belt, similar to sun light shining through a clean, clear-glass windowpane, then virtually no absorption of that energy occurs. The energy moves though and exits the belt having essentially the same wavelength, intensity and wave profile as the incident beam. Once a layer of toner is deposited on the working surface of the belt, the properties of the energy, specifically the wavelength and bandwidth are selected to be absorbed by the toner layer. For example thick layers of black toner can effectively block and prevent transmission of white light. Various colored toners will block or transmit different intensities of various frequency wavelengths depending upon their absorption properties which are referred to as their absorption coefficient. Thus, by selecting the properties of the light to be transmissive by the belt member and absorptive by the toner layer, the properties of the toner layer can be, as described in greater detail below, discerned. FIG. 1 shows a sensor that is a single-mode (e.g., transmissive mode only) sensor where the light source is mounted over the functional and image bearing (e.g., topside) of the transfer belt and the sensor receiver is below the non-image bearing side. The light is applied directly incident to the topside of the transfer belt. The frequency and intensity of transmitted light may be selected and adjusted in real-time to optimize detection of the various colored toners including black based upon analysis of a feedback loop that monitors key parameters such as, but not limited to, maximum detected intensity, color gamut, and the like. Since colored toners behave similar to a spectral filter, they can absorb portions of the light spectrum that match or are similar to their intrinsic color. Thus broad spectrum light when passed through a colored toner layer looses a portion of the specific wavelength(s) by absorption by the toner. The sensing system can thereby employ this selective absorption to detect specific color and other properties of interest of toner layers that reside upon the surface of the transfer belt member.

Further, the positions of the light source and sensor may be reversed depending upon the requirements of the particular system design.

For an intermediate belt system, when toner is transferred to the transfer belt (e.g., during the first transfer) and moved into view of the transmission sensor, the quantity or other properties of interest such as color or mixtures of color of the toner mass is inferred in real time as light transmission is a strong function of toner mass and absorption properties. A control algorithm is executed by the measurement and control circuit to adjust critical first and second transfer set points. After a representative second transfer, the residual toner is measured so further adjustments to the first and second transfer set points are performed in order to optimize the overall performance of the transfer system. The measurements taken in real-time and providing fine image details not previously obtainable with accuracy allow this optimization. As stated previously, this transfer system may be applied to both intermediate transfer belt systems as well as biased transfer belt and roll systems.

Further, multiple sensors may be used at various locations along the periphery of the transfer member to represent more complex sensing protocols as may be required by a particular application. In one embodiment, there is provided a transfer system that uses a combination of transmission-based and reflective-based sensors. Use of a multimode sensing configuration allows for another method for detection and correction of defects or anomalies during the transfer process. Namely, such a configuration will allow for the real-time detection and correction of not only general defects and anomalies of toner mass transfer, but also of real-time defects and anomalies exhibited within-toner-layer during the transfer.

Figure 2:
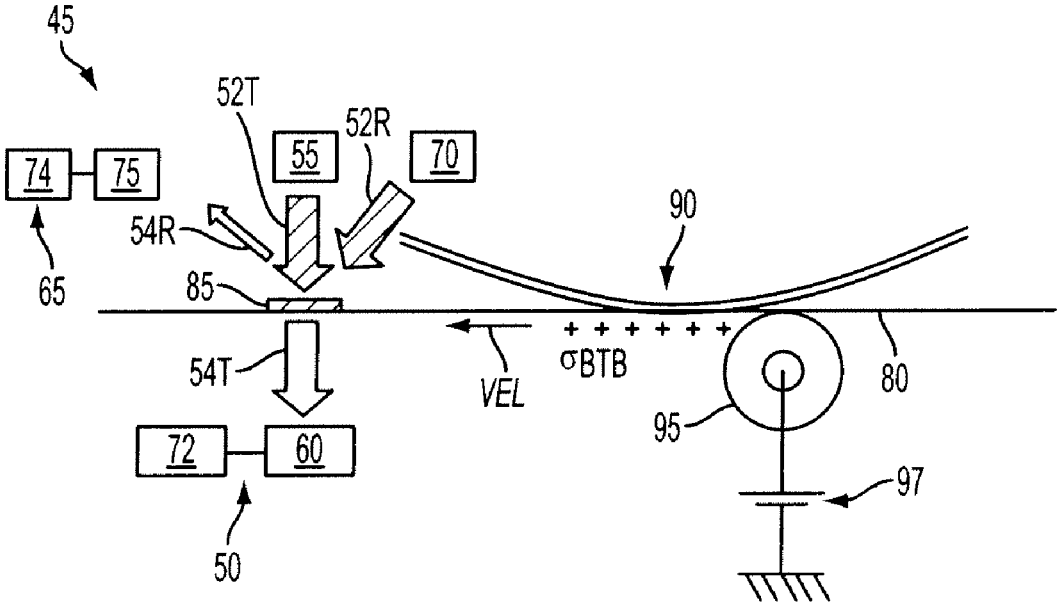
FIG. 2 is a schematic side view of an alternative transfer belt system according to the present embodiments.

FIG. 2 illustrate another embodiment in the transfer system 45 employs a transmission-based sensor 50 (having a transmission light source 55 and transmission receiver 60), similar to that shown in FIG. 1, which is coupled with a reflective-based sensor 65 (having a reflective light source 70 and reflective receiver 75) to comprise a multimode sensor which can be used in conjunction with the light-transmissive transfer belt 80. The transmission-based sensor 50 and reflective-based sensor 65 each deliver a stream of light 52T, 52R to the intermediate transfer belt 80. While the transmission-based sensor applies the light directly incident and essentially orthogonal to the topside of the transfer belt, the reflective-based sensor 50 applies the light at an angle. In embodiments, the angle is from about 1 degrees to about 89 degrees. The incident angle of the reflective-based energy source and sensor is, in general, selected to provide an output signal that most efficiently and effectively represents the particular characteristics of the belt's surface and the toner layer(s) that are of interest or which are to be controlled. For example, if the objective is to accurately detect the extremely low toner masses at low surface densities which are characteristic of the belt's surface after transfer and after cleaning, then a relatively high intensity energy source configured at a relatively low incident angle, for example 10-20 degrees to the belt's surface may be selected. And in so doing, one would center upon observation of differences displayed by the belt's surface reflectivity as subtle perturbations occur due to the distribution of a sparse population of toner particles on the subject surface. In general, low incident angles can be used to view characteristics of the belt's surface and details of the surface's interface with particles. On the other hand, if the objective is to examine either the uniformity of the toner layer's pile height or irregularities in the toner's surface layer then one may choose a greater incident angle, for example 40 to 60 degrees and in so doing one would tend to focus upon refractance of the energy from the toner's particulate and irregular surfaces and thereby secure a insights into the topography and uniformity of thicker, more dense toner deposits. The foregoing are given as examples only and not being bound by any particular operational theory, in practice, one may establish by experiment a given selection of the incidence angle of the reflective/refractive source energy and sensor that may be within the ranges provided herein or may be different depending upon the specific requirements of the application. The respective sensors 50, 65 are connected to measurement and control circuits 72, 74 that can compute the difference in light transmission 54T and the different in light reflectance 54R with and without a toner mass 85 on the surface of the transfer belt 80. As in FIG. 1, the transfer system 45 shown in FIG. 2 is used with a suitable photoreceptor 90. The photoreceptor 90 may be in the form of either a drum or belt. The transfer system 45 also includes a biased transfer back up roller 95 coupled to a suitable voltage or current source 97 to deliver charge to the backside of the transfer belt 80.

In the configuration illustrated in FIG. 2, the transmission-based light source, which may provide broad area or narrow area coverage and may be wide spectrum or narrow, is optimized to transmit selected frequency, pulse length, and intensity light. The second energy source, which may use the same or different energy frequency and intensity, is used with the reflective-based sensor adapted to supply and detect light reflected from the toner mass that resides on the image-bearing surface or the top-side of the transfer belt. In embodiments, the transmission energy applied to the light-transmissive transfer belt may have a wavelengths selected from anywhere within the electromagnetic energy spectrum and may specifically fall within the spectrum of light which spans from ultraviolet to infrared or from about 10 nm to about 10,000 nm, or from about 700 nm to about 3,000 nm. An intensity of the transmission light applied to the light-transmissive transfer belt may be any level from above 0 to about 1000 lumens.

A time- or position-based output signal is obtained from each sensor and is used to compute attributes of the toner mass relating to print quality or system optimization, such as mass on belt (MOB) or density, uniformity, graininess, mottle, snow, streaks, and the like. The use of the two sensing devices, e.g., the transmission-based and reflective-based sensors, as shown comprises a novel multimode toner sensing configuration that provides significant improvement in known single-mode configurations. While the sensors are shown in a post-transfer position (e.g., downstream of the first transfer), the sensors can be used anywhere along the transfer belt including, but not limited to post transfer, pre-transfer, both pre- and post transfer, pre- and post-clean, and elsewhere. Furthermore, the use of multimode sensing (either as a single multimode sensor in pairs or in groupings or sensors employing different light intensities and/or frequencies) allows computational differentiations of the output signals from the groupings or pairs of sensors and thereby provides differential output signals to provide more accuracy in sensing toner mass. The differentiated signal can be used as circumstances may require, for example either off-line or on-line, pinpointing and quantifying certain macro- or microscopic aspects of the toner mass that may be of interest or in need of control.

Also provided in the present embodiments is a method for detecting and adjusting toner transfer performance in real-time. In specific embodiments, the method comprises delivering a stream of transmission energy to a position on a light-transmissive (biased) transfer belt where a toner mass is to be transferred, receiving the transmitted energy through the light-transmissive transfer belt, measuring at least one of an intensity or a frequency shift of the transmission energy received through the light-transmissive transfer belt and determining a difference of the intensity of the transmission received through the light-transmissive transfer belt with and without a toner mass, calculating a transfer parameter that can be used to adjust toner transfer performance, and adjusting toner transfer performance responsively to the calculated transfer parameter, thereby optimizing such toner transfer performance. In further embodiments, the method may further include delivering a stream of reflective energy such as visible light to the position on a light-transmissive transfer belt where the toner mass is to be transferred, receiving the light reflected from the light-transmissive transfer belt, and measuring an intensity of the reflective light received from the light-transmissive transfer belt and determining a difference of the intensity of the reflective light received from the light-transmissive transfer belt with and without a toner mass. In such embodiments, the calculating of a transfer parameter that can be used to adjust toner transfer performance is based on the determined difference of the intensity of the transmission light and the difference of the intensity of the reflective light. In embodiments, the calculated transfer parameter may be selected from the group consisting of maximum detected intensity, color gamut, frequency shift, and spectral dispersion.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The examples set forth herein below and are illustrative of different compositions and conditions that can be used in practicing the present embodiments. All proportions are by weight unless otherwise indicated. It will be apparent, however, that the present embodiments can be practiced with many types of compositions and can have many different uses in accordance with the disclosure above and as pointed out hereinafter.

A sample of a PVDF composite film was requested and received from a trusted supplier (Dynaox, Japan) and characterized for those properties believed to be critical to function. As shown in Table 1, a series of surface resistivity measurements were made on various regions of the PVDF sample which represent a known critical parameter relating to transfer belt performance and were made as a function of applied field and found to range between about 8.6 to $9.8\times10^{10}$ Ω/sq. As the surface resistivity measurements are shown to be on the order of about $10^{10}$ to $10^{11}$ Ω/sq., this puts the values determined on the subject PVDF sample solidly into the earlier defined range which defines the operational region of many transfer belt applications.

TABLE 1

| Applied Voltage (volts, dc) | 1 st measurement ($\times10^{10}$ Ω/sq.) | $2^{nd}$ measurement | 3 rd measurement |
|---|---|---|---|
| 100 | 9.29 | 9.28 | 9.41 |
| 250 | 9.81 | 9.32 | 9.1 |
| 500 | 9.15 | 8.83 | 9.6 |
| 1000 | 9.2 | 8.52 | 8.6 |

Example 1

Figure 3:
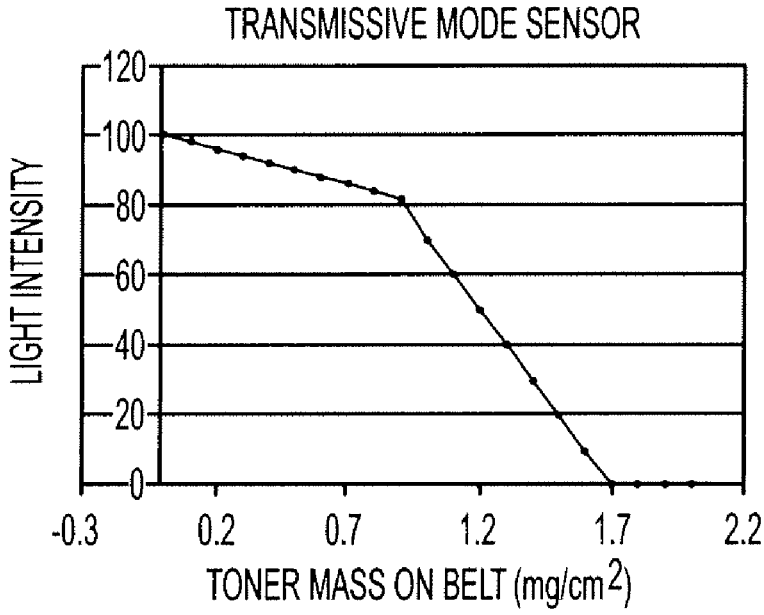
FIG. 3 is a graph illustrating responses of a transmission-based sensor in detecting light intensity as a function of toner mass on the intermediate transfer belt.
Figure 4:
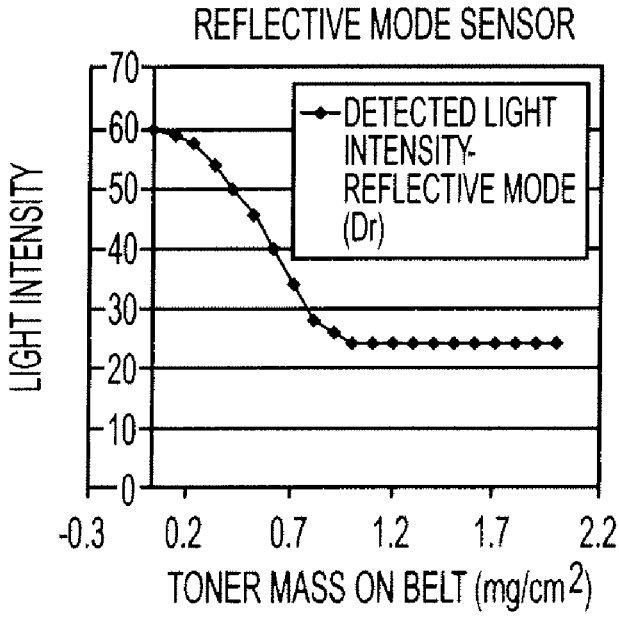
FIG. 4 is a graph illustrating responses of reflective-based sensor in detecting light intensity as a function of toner mass on the intermediate transfer belt.

A mathematical model based upon first principles physics has been constructed and employed to probe various sensing scenarios achieved by integrating the optical and electrical properties of the light-transmissive transfer belt. FIGS. 3 and 4 illustrate the hypothetical responses of the transmissive-based (transmissive mode) and reflective-based (reflective mode) sensors shown in FIG. 2 as the toner mass on the surface varies from 0 to about 2 gms/cm$^2$. The graph illustrated in FIG. 3 represents the transmissive mode visible light output intensity as a function of toner mass while the graph illustrated in FIG. 4 reflects reflective mode light intensity as a function of toner mass. In both modes, light intensity is shown to vary with the amount of toner in the pathway of the light. With slight toner masses (e.g., <about a monolayer or about <1 gm/cm$^2$), the responses are shown to track rather differently which is largely due to the differences between the absorption and reflection properties of the discrete particle-based, discontinuous layers. Both responses are shown to saturate, although at different final relative intensities, once the toner mass reaches the height of more than one toner layer. Slight toner mass usually refers to a partial mono-layer which falls into a density range less than about 1 mg/cm$^2$ and which can be visible to the naked eye and enough to cause print quality problems such as background. Very slight toner masses may require magnification to be able to detect and/or see and may not cause immediate print quality problems but may impact xerographic performance over the long term.

Irregularities that may occur in the relatively thick (>1 monolayer) toner piles which relate to print quality defects such as streaks or mottle may be detected as irregularities (and not noise) anywhere along the top-side reflected signal. This is not possible in the transmissive mode once the layer becomes thick enough to saturate the output, unless the streaks are sufficiently deep to fall below the about more than one monolayer that is the point of saturation in the transmissive mode.

Example 2

Figure 5:
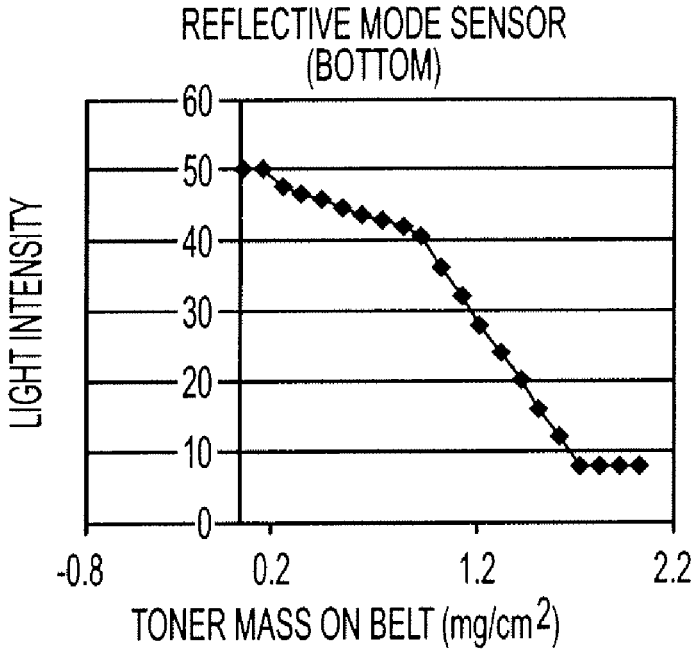
FIG. 5 is a graph illustrating responses of a reflective-based sensor in detecting light intensity as a function of toner mass on a intermediate transfer belt when focused on the non-toned side of the intermediate transfer belt.

FIG. 5 illustrates graphical results from a model created to illustrate the hypothetical behavior of a reflective mode sensor (similar to that shown in FIG. 2) that has been mounted on the non-toned or backside surface of a light-transmissive transfer belt and which has been focused at the underside of the toner-belt surface interface. The angle of incident and reflected light is adjusted to accommodate, for example, the thickness and functional transparency of the transfer belt as well as the desired initial signal response without toner on the belt. In comparison to FIGS. 3 and 4, one observes a shift in various parameters of interest and importance. For example, there is a subtle shift in the baseline intensity (50 versus 60 arbitrary units of intensity), which is due to the loss of intensity by the light beam traveling through the thickness of the transfer belt. This parameter can be compensated by adjusting the light source intensities appropriately. In addition, such shifts in baseline data may be used to monitor changes to the belt as it is used and becomes contaminated or as it approaches failure due to, for example formation of stress cracks in the belt. In addition, one can observe a significant shift in the point of saturation as well as a decrease in slopes of both the initial and transition regions, which is likely due to the variations in light behavior as it reflects from a bound as opposed to an unbound surface (e.g., the bottom of the toner layer is bound or constrained by the surface of the transfer belt while the top side of the uppermost toner layer is essentially unbound).

Example 3

Figure 6:
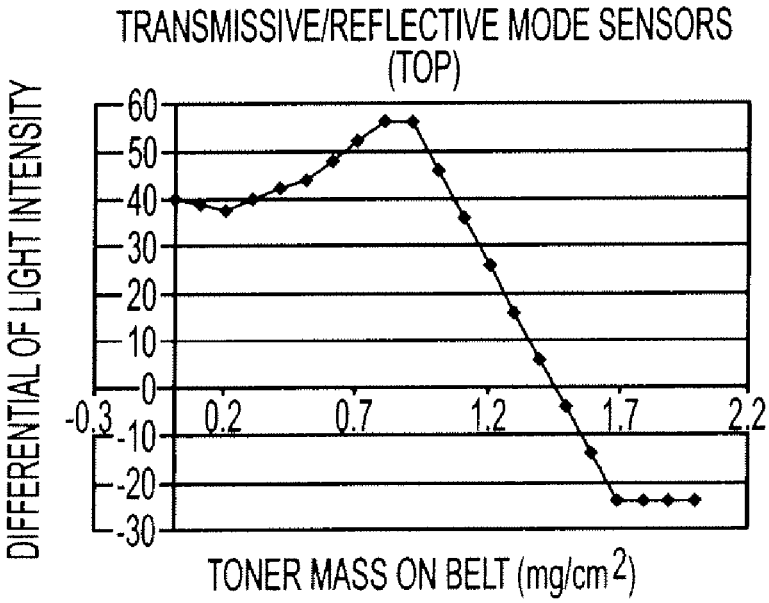
FIG. 6 is a graph illustrating differences in transmission-based sensor signal output and reflective-based sensor signal output based on toner mass on the intermediate transfer belt.

FIG. 6 illustrates another graphical result from the above model to further illustrate the notion that simple differentiation can be used to amplify the appearance of, and/or electronic signal resulting from certain transitions that may occur in the toner masses and which may be used to improve precise control. FIG. 6 illustrates the results from a configuration having both a transmissive mode sensor and a reflective mode sensor positioned on the top of the transfer belt. The output signals of the transmissive mode minus those of the reflective mode give the resulting differentials of signal intensity. In comparison of FIGS. 3 and 4 to FIG. 6, one observes that the shape of the critical portions of the curves prior to and after the points of inflection is significantly different. In FIG. 6, the differentiated signal intensity is depicted as increasing exponentially with toner mass. The slope of the initial portion of the curve represents regions where toner layers are less than a monolayer and illustrates the transition between a monolayer where light saturation is believed to occur and the point of super saturation which is attributed to higher toner masses. The post-inflection region where the slope decrease is more gradual and monotonous may be used to quantify pre-transfer toner mass on the transfer belt to control such print quality aspects as color saturation, overall pile height, and the like.

Lastly, in FIG. 6, while the negative values for the signal intensity that do not occur in FIGS. 3 and 4 may be an artifact of the mathematics, this region may also be representative of the curve that relates to formation of the critical multiple layers where total light saturation occurs. To optimize transfer, knowing if and when this particular highest mass of toner was occurring on the subject print would allow the opportunity to make real-time, radical adjustments to the transfer controls before saturation occurs such that failure or loss of transfer efficiency can be avoided.

Example 4

Figure 7:
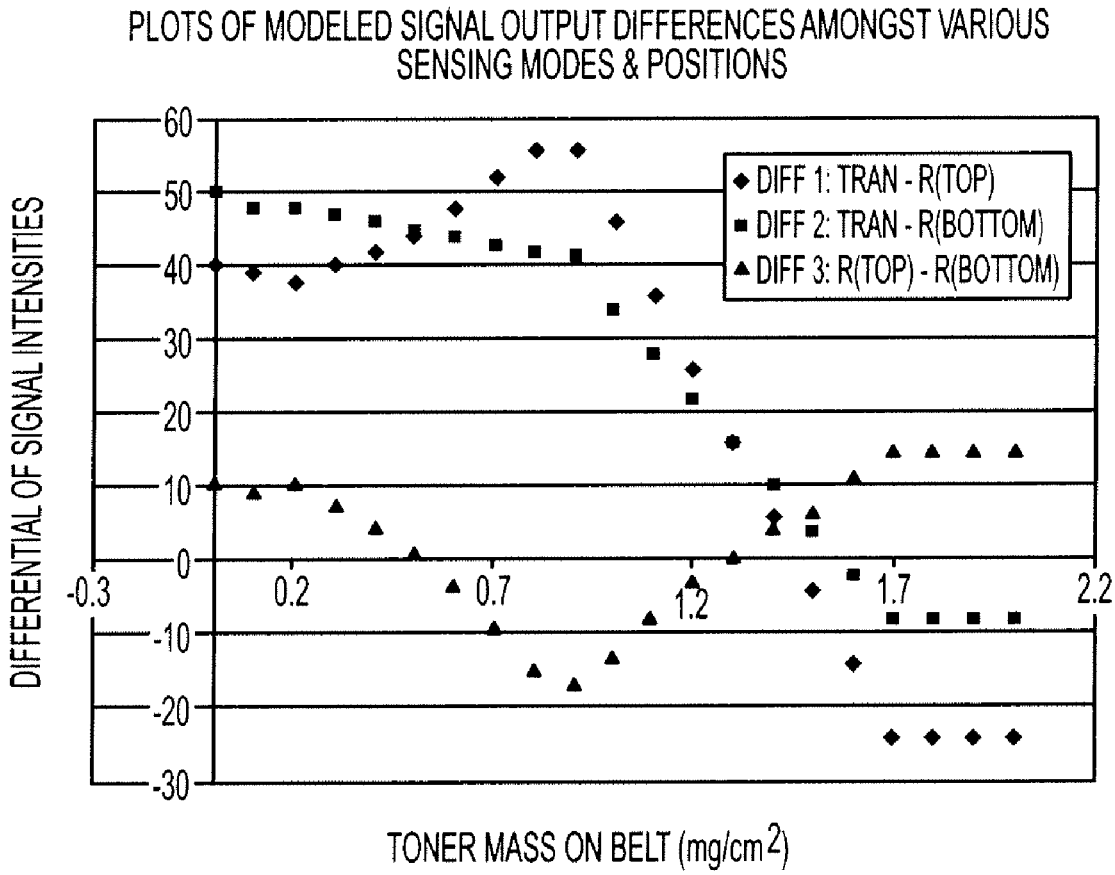
FIG. 7 is a graph illustrating differences in signal output from sensors based on various sensing modes and located at various positions in the system.

FIG. 7 is a graph that illustrates features of the differentials that can be produced from signal processing the signals from various multimode sensors. FIG. 7 plots the differences in signal output from sensors based on various sensing modes and located at various positions in the system. These results can be used to indicate the optimum configuration for each system and to provide better control of various aspects of the xerographic process.

In sum, various exemplary embodiments of the multimode sensor configuration and control scheme based upon a unique light-transmissive biased transfer belt member are described herein. The present embodiments can be used to obtain more effective xerographic printing of variable data on packaging substrates as such embodiments will provide real-time control and wider range of adjustment to the critical transfer process parameters.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A system for providing detection and adjustment of toner transfer performance, comprising:

a light-transmissive transfer belt for receiving an amount of toner mass;

a transmission sensor for sensing light transmission through the light-transmissive transfer belt, the sensor comprising:

a light source positioned over the light-transmissive transfer belt for applying light to a position on a surface of the light-transmissive transfer belt where the amount of toner mass is to be transferred, and a receiver positioned on a side of the light-transmissive transfer belt opposite from the light source for receiving and measuring an amount of light that passes through the light-transmissive transfer belt; and a measurement and control circuit connected to the transmission sensor for computing a difference in light transmission with and without an amount of toner mass on the surface of the light-transmissive transfer belt, wherein the difference in light transmission is used to calculate a transfer parameter that can be used to adjust toner transfer performance.

2. The system of claim 1, wherein the light-transmissive transfer belt is an intermediate transfer belt or a biased transfer belt.

3. The system of claim 1 further including a transfer back up roller in contact with the light-transmissive transfer belt and coupled to a voltage or current source for delivering charge to a backside of the light-transmissive transfer belt.

4. The system of claim 1, wherein the light-transmissive transfer belt has a bulk resistivity of from about $1\times10^{2}$ Ωcm. to about $10\times10^{12}$ Ωcm.

5. The system of claim 1 being adapted for use with a drum photoreceptor or a belt photoreceptor.

6. The system of claim 1, wherein the positions of the light source and the receiver are reversed.

7. The system of claim 1, wherein the light applied to the light-transmissive transfer belt has a frequency of from about 10 nm to about 10,000 nm.

8. The system of claim 1, wherein the light applied to the light-transmissive transfer belt has an intensity of from above 0 to about 1000 lumens.

9. The system of claim 1, wherein the light-transmissive transfer belt is clear.

10. The system of claim 1, wherein the measurement and control circuit connected to the transmission sensor further computes a difference in light transmission with and without contamination on the surface of the light-transmissive transfer belt, and further wherein the difference in light transmission is used to calculate a transfer parameter that can be used to adjust at least one of toner transfer performance and contamination transfer performance.

11. The system of claim 10, wherein the contamination is selected from the group consisting of residual lubricant, residual charge control agent, debris from print substrates, and mixtures thereof.

12. A system for providing detection and adjustment of toner transfer performance, comprising:

a light-transmissive transfer belt for receiving an amount of toner mass;

a transmission sensor for sensing light transmission through the light-transmissive transfer belt, the sensor comprising:

a transmission light source positioned over the light-transmissive transfer belt for applying light to a position on a surface of the light-transmissive transfer belt where an amount of toner mass is to be transferred, and a first receiver positioned on a side of the light-transmissive transfer belt opposite from the transmission light source to receive and measure an amount of transmitted light that passes through the light-transmissive transfer belt;

a reflective sensor coupled to the transmission sensor for sensing light reflected from the light-transmissive transfer belt, the reflective sensor comprising:

a reflective light source positioned over the light-transmissive transfer belt for applying reflective light to the position on a surface of the light-transmissive transfer belt where an amount of toner mass is to be transferred, and a second receiver positioned on a same side of the light-transmissive transfer belt as the reflective light source for receiving and measuring an amount of reflective light from the light-transmissive transfer belt; and one or more measurement and control circuits connected to the transmission sensor and the reflective sensor for computing a difference in at least one of intensity and frequency of transmitted light with and without an amount of toner mass on the surface of the light-transmissive transfer belt and a difference in at least one of intensity and frequency of reflective light with and without an amount of toner mass on the surface of the light-transmissive transfer belt, wherein the difference in the intensity or frequency of the transmitted light and reflective light is used to calculate a transfer parameter that can be used to adjust toner transfer performance.

13. The system of claim 12, wherein the light-transmissive transfer belt is an intermediate transfer belt, a biased transfer belt, or a biased transfer roll.

14. The system of claim 12 further including a transfer back up roller in contact with the light-transmissive transfer belt and coupled to a voltage or current source for delivering charge to a backside of the light-transmissive transfer belt.

15. The system of claim 12, wherein the light-transmissive transfer belt has a bulk resistivity of about $1\times10^{2}$ Ωcm to about $10\times10^{12}$ Ωcm.

16. The system of claim 12 being adapted for use with a drum photoreceptor or a belt photoreceptor.

17. The system of claim 12, wherein the transmission light applied to the light-transmissive transfer belt has a frequency of from about 10 nm to about 10,000 nm and an intensity of from above 0 to about 1000 lumens.

18. A method for detecting and adjusting toner transfer performance, comprising:

delivering a stream of transmission light to a position on a light-transmissive transfer belt where an amount of toner mass is to be transferred;

receiving the light transmitted through the light-transmissive transfer belt with and without the amount of toner mass;

measuring at least one of an intensity and frequency of the transmission light received through the light-transmissive transfer belt and determining a difference of at least one of the intensity and frequency of the transmission light received through the light-transmissive transfer belt with and without the amount of toner mass;

calculating a transfer parameter that can be used to adjust toner transfer performance; and adjusting toner transfer performance responsively to the calculated transfer parameter, thereby optimizing such toner transfer performance.

19. The method of claim 18 further including delivering a stream of reflective light to the position on a light-transmissive transfer belt where the toner mass is to be transferred;

receiving the light reflected from the light-transmissive transfer belt with and without the amount of toner mass; and measuring at least one of an intensity and frequency of the reflective light received from the light-transmissive transfer belt and determining a difference of at least one of the intensity and frequency of the reflective light received from the light-transmissive transfer belt with and without a toner mass.

20. The method of claim 19, wherein the calculating of a transfer parameter that can be used to adjust toner transfer performance is based on the determined difference of the intensity of the transmission light and the difference of the intensity of the reflective light.

21. The method of claim 18 further including a measuring of at least one of an intensity and frequency of transmission light received through the light-transmissive transfer belt and determining a difference of at least one of the intensity and frequency of the transmission light received through the light-transmissive transfer belt with and without contamination on the light-transmissive transfer belt, wherein the difference is used to calculate a transfer parameter that can be used to adjust at least one of toner transfer performance and contamination transfer performance.

22. The method of claim 18, wherein the calculated transfer parameter is selected from the group consisting of maximum detected intensity, color gamut, frequency shift, and spectral dispersion.

23. The method of claim 18, wherein the transmission light applied to the light-transmissive transfer belt has a frequency of from about 10 nm to about 10,000 nm and an intensity of from above 0 to about 1000 lumens.

* * * * *